US007051972B2

(12) United States Patent
Milliorn et al.

(10) Patent No.: US 7,051,972 B2
(45) Date of Patent: May 30, 2006

(54) ROLL DISPENSER

(75) Inventors: James Michael Milliorn, Fort Worth, TX (US); Andrew Brian Milliorn, Kennedale, TX (US)

(73) Assignee: Ecolab Inc., St. Paul, MN (US)

( * ) Notice: Subject to any disclaimer, the term of this patent is extended or adjusted under 35 U.S.C. 154(b) by 339 days.

(21) Appl. No.: 10/675,373

(22) Filed: Sep. 30, 2003

(65) Prior Publication Data

US 2005/0077422 A1 Apr. 14, 2005

(51) Int. Cl.
*B65H 49/06* (2006.01)

(52) U.S. Cl. ..... 242/588.6; 206/408

(58) Field of Classification Search ..... 242/588, 242/588.3, 588.6, 400, 401, 405, 404.3, 406; 206/389, 397, 408, 411, 413, 415, 416; 225/46–50, 225/88, 90; D19/69
See application file for complete search history.

(56) References Cited

U.S. PATENT DOCUMENTS

| | | | | | |
|---|---|---|---|---|---|
| 777,044 | A | * | 12/1904 | McWilliam | 242/404.3 |
| D125,085 | S | * | 2/1941 | Jackson | D19/69 |
| 2,295,477 | A | * | 9/1942 | Jackson | 225/90 |
| D164,733 | S | * | 10/1951 | Pretzfelder, Jr. | D19/69 |
| 3,972,459 | A | * | 8/1976 | Cooper | 225/47 |
| 4,060,444 | A | * | 11/1977 | Schweig, Jr. et al. | 206/411 |
| 4,700,835 | A | * | 10/1987 | Rognsvoog, Jr. | 206/411 |
| 4,787,168 | A | * | 11/1988 | Benit et al. | 242/588.6 |
| D338,493 | S | * | 8/1993 | Mead | D19/69 |
| 5,735,400 | A | * | 4/1998 | Packard | 206/408 |
| 6,386,416 | B1 | * | 5/2002 | Dunshee et al. | 225/49 |
| 6,481,607 | B1 | * | 11/2002 | Van Cott | 225/46 |

* cited by examiner

*Primary Examiner*—William A. Rivera
(74) *Attorney, Agent, or Firm*—Andrew D. Sorensen; Anneliese M. Seifert

(57) ABSTRACT

An adhesive tape or label roll dispenser is disclosed. The dispenser is preferable manufactured from a single piece and includes a front panel with connected adjacent side panels. Each side panel includes a protruding pin. The user centers the adhesive tape or label roll on one protruding pin and bends the front panel and the other side panel around the label, centering the other protruding pin through the roll. The distal end of each pin includes an engaging clip enabling the distal ends of each pin to fixedly engage and secure the roll within the dispenser. The dispenser also includes a hook on each side panel at the edge opposite the front panel, enabling the user to suspend the dispenser from a utility shelf or wall bracket.

5 Claims, 6 Drawing Sheets

FIG.15
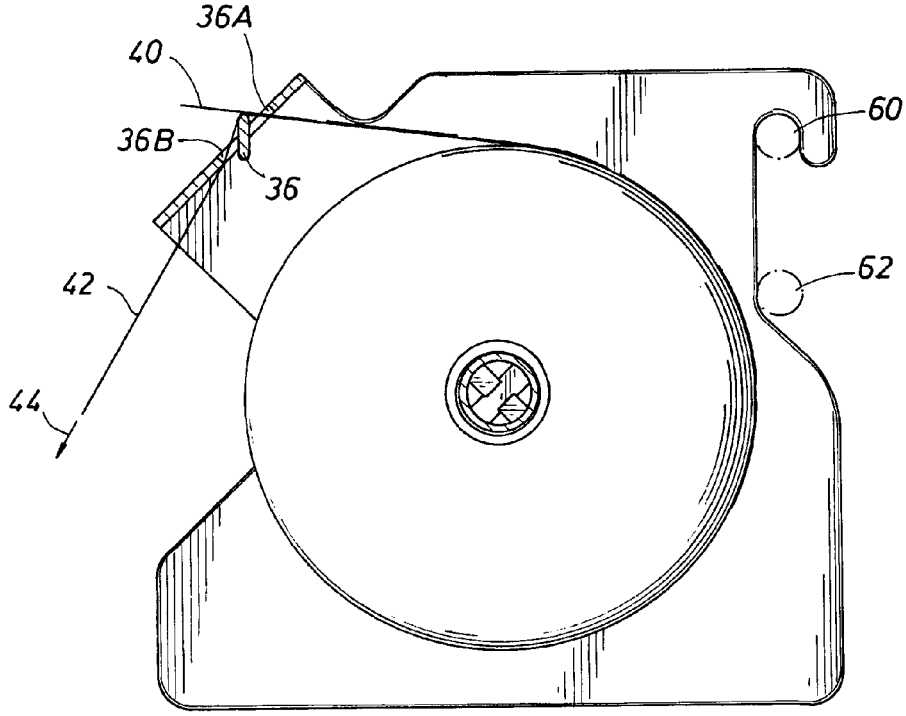
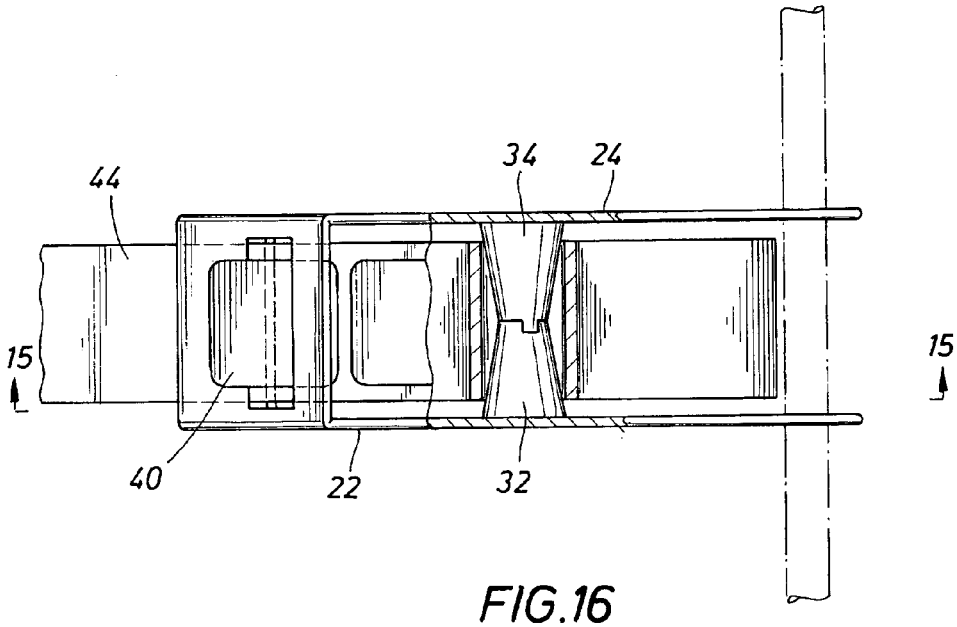
FIG.16

ROLL DISPENSER

STATEMENT REGARDING FEDERALLY SPONSORED RESEARCH OR DEVELOPMENT

None.

BACKGROUND OF THE INVENTION

1. Field of the Invention

The present invention relates to a roll dispenser. More particularly, the present invention relates to an improved label roll dispenser manufactured and assembled from a single piece.

2. Description of the Prior Art

Adhesive tape and label roll dispensers have historically been manufactured from a complex mold resulting in a multitude of sides and edges. Typically, disposable dispensers are sold with a roll of either adhesive tape or labels, while non-disposable dispensers are generally sold separately. In either event, such dispensers are generally assembled when sold as they are not particularly easy for the user to assemble. Furthermore, such dispensers are not generally suitable for use in a variety of settings, such as being suspended from a shelf, bar, or wall bracket.

Accordingly, there is a need for an improved dispenser which can be easily manufactured as a single piece, easily assembled by the user, and supported in a variety of ways, including being suspended from a utility shelf or wall bracket.

BRIEF SUMMARY OF THE INVENTION

The present invention is an improved adhesive tape or label roll dispenser manufactured as a single piece. The single piece comprises a front panel and associated side panels. Each side panel has a pin protruding outwardly generally proximate the center of each side panel. The user centers the roll on one protruding pin and bends the front panel and the other side panel around the roll. In this manner the distal end of one protruding pin engages the distal end of the other protruding pin, through the center of the roll, and lock in place. The user would then thread the roll through a dispensing bar on the front panel. Preferably, hooks are provided at the opposite end of each side panel from the front panel thereby enabling the user to suspend the dispenser from a utility shelf or wall bracket. This facilities the removal of labels or adhesive tape from the roll as the need arises.

The foregoing description is intended to be a summary only. Specific details of the present invention are described more fully in the detailed description below and then the claims appended hereto.

BRIEF DESCRIPTION OF THE DRAWINGS

In order to more fully understand the drawing referred to in the detail description of the present invention, a brief description of each drawing is provided;

FIG. 15 is an elevation view of the present invention once assembled with an installed roll of labels; and FIG. 16 is a bottom view of the present invention once assembled with an installed roll of labels.

DETAILED DESCRIPTION OF THE INVENTION

Figure 1:
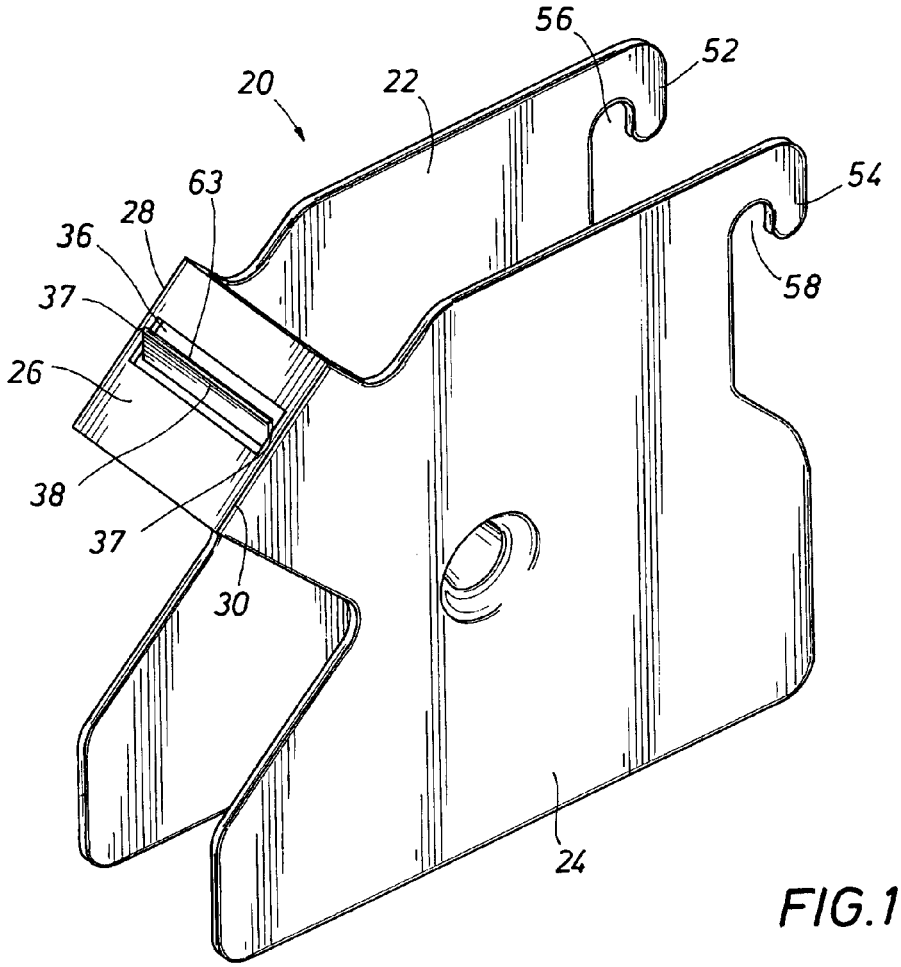
FIG. 1 is a perspective view of the present invention.
Figure 2:
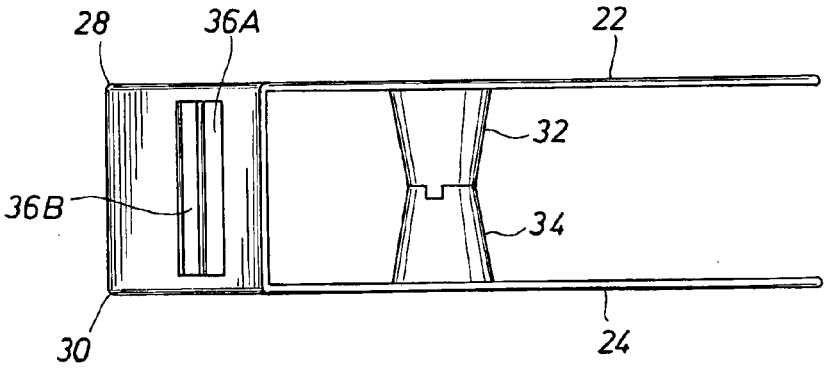
FIG. 2 is a top view of the present invention.

Referring to FIGS. 1–7 of the present invention, the improved roll dispenser 20 includes side panels 22 and 24. Each side panel is attached along one edge to front panel 26. In the case of panel 22, it is along edge 28, and in the case of panel 24 it along edge 30.

Protruding pin 32 is attached to panel 22. Protruding pin 34 is attached panel 24. Each protruding pin 32, 34 may be manufactured separately and subsequently attached to the respective panel or may be molded in an integral manner, which is the preferred method of manufacturing. Each protruding pin 32, 34 is generally located in the general center of each side panel 22, 24 so that the roll is centrally located as shown in FIG. 15.

Front panel 26 includes an aperture 36 in which dispensing bar 38 is centrally supported. Each end 37 of bar 38 is attached to the front panel. Thus, the bar serves to divide aperture 36 into two regions—36A and 36B. Referring briefly to FIGS. 15 and 16, dispensing bar 38 serves to separate a label 40 from the roll 42. This is accomplished by threading the roll 42 first through aperture 36A and then aperture 36B. When the user pulls down on roll 42 in the direction of arrow 44 (see FIG. 15), tape 42 is advanced and label 40 is separated from tape 42 at the edge of bar 36.

Figure 3:
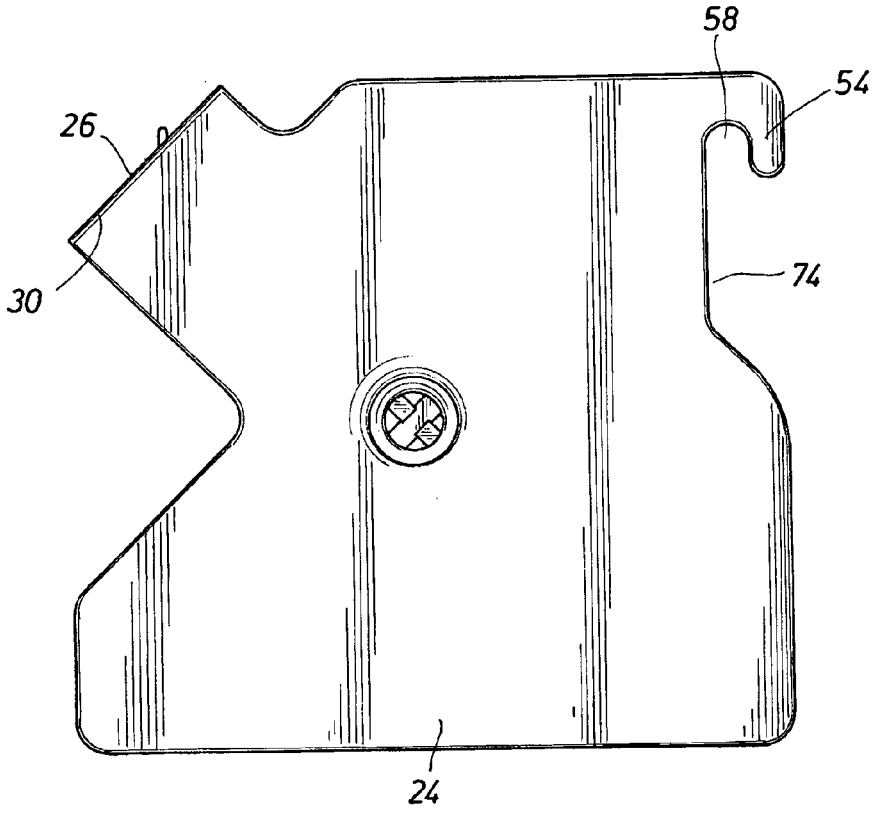
FIG. 3 is a right side view of the present invention.
Figure 4:
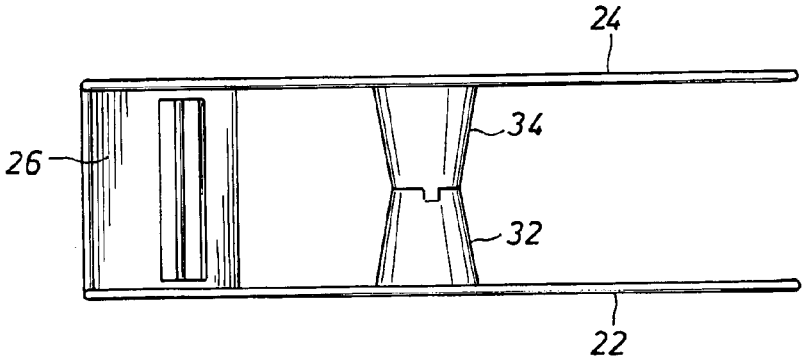
FIG. 4 is a bottom view of the present invention.
Figure 7:
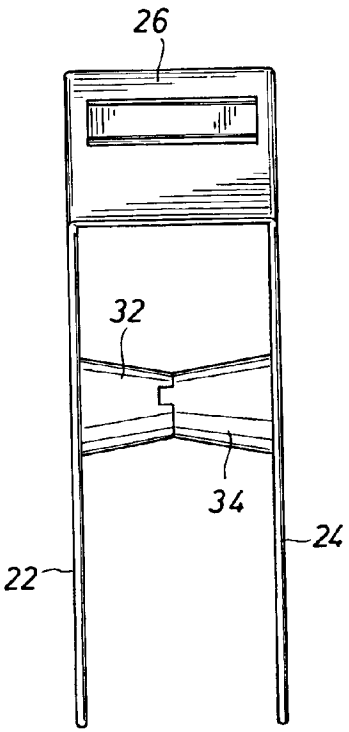
FIG. 7 is a front view of the present invention.
Figure 5:
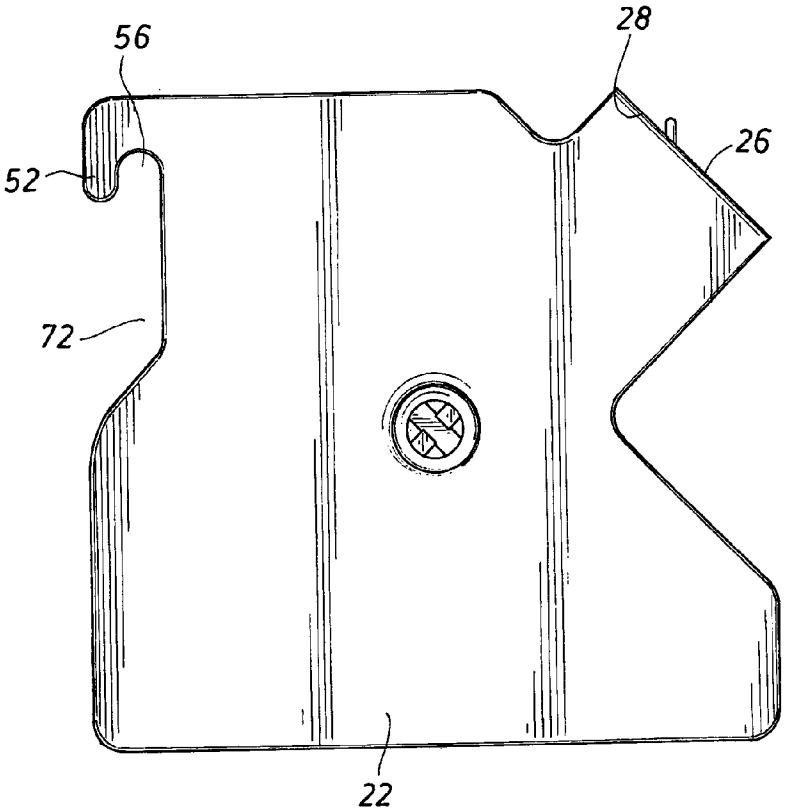
FIG. 5 is a left side view of the present invention.
Figure 6:
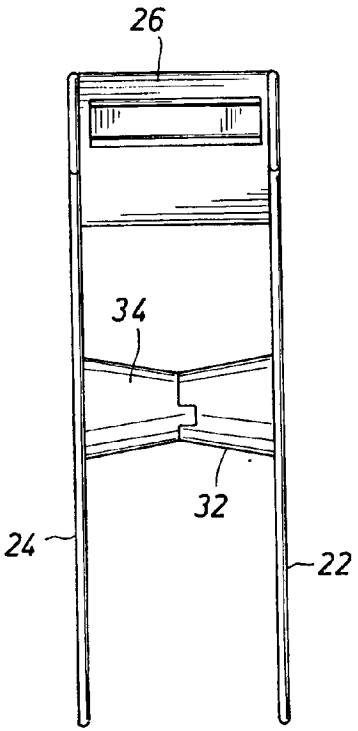
FIG. 6 is a back view of the present invention.

Referring back to FIGS. 1–7, each side panel 22, 24 includes a hook arrangement to suspend the present invention from a utility shelf or wall bracket. In the case of side panel 22 it is hook arrangement 52; in the case of side panel 24, it is hook arrangement 54. Hereinafter, each hook arrangement 52, 54 may be referred to simply as a hook. Referring to FIGS. 1, 3 and 5, hook 52 descends generally downwardly defining an open region 56. Similarly, hook 54 descends generally downwardly defining an open region 58. Referring briefly to FIGS. 15–16, such open regions 56, 58 provide space for a bar 60 of a utility shelf or wall bracket. It may be preferable for each open region 56, 58 to extend downwardly as shown in FIGS. 1, 3, 5, and 15 for a pre-determined distance. Referring to FIG. 3, this region is generally shown as region 74 for side panel 24 and, referring to FIG. 5, this region is referred to as region 72 for side panel 22. Referring back to FIG. 15, each such region 72, 74 provides an area where a second bar 62 may rest providing lateral resistance against side panels 22, 24 thereby preventing the present invention from rotating about bar 60. In this manner, the present invention may be suspended from a utility shelf or wall bracket, or other wall support systems.

The user may thereafter easily remove labels at a more comfortable working level above a counter or other work place.

Figure 8:
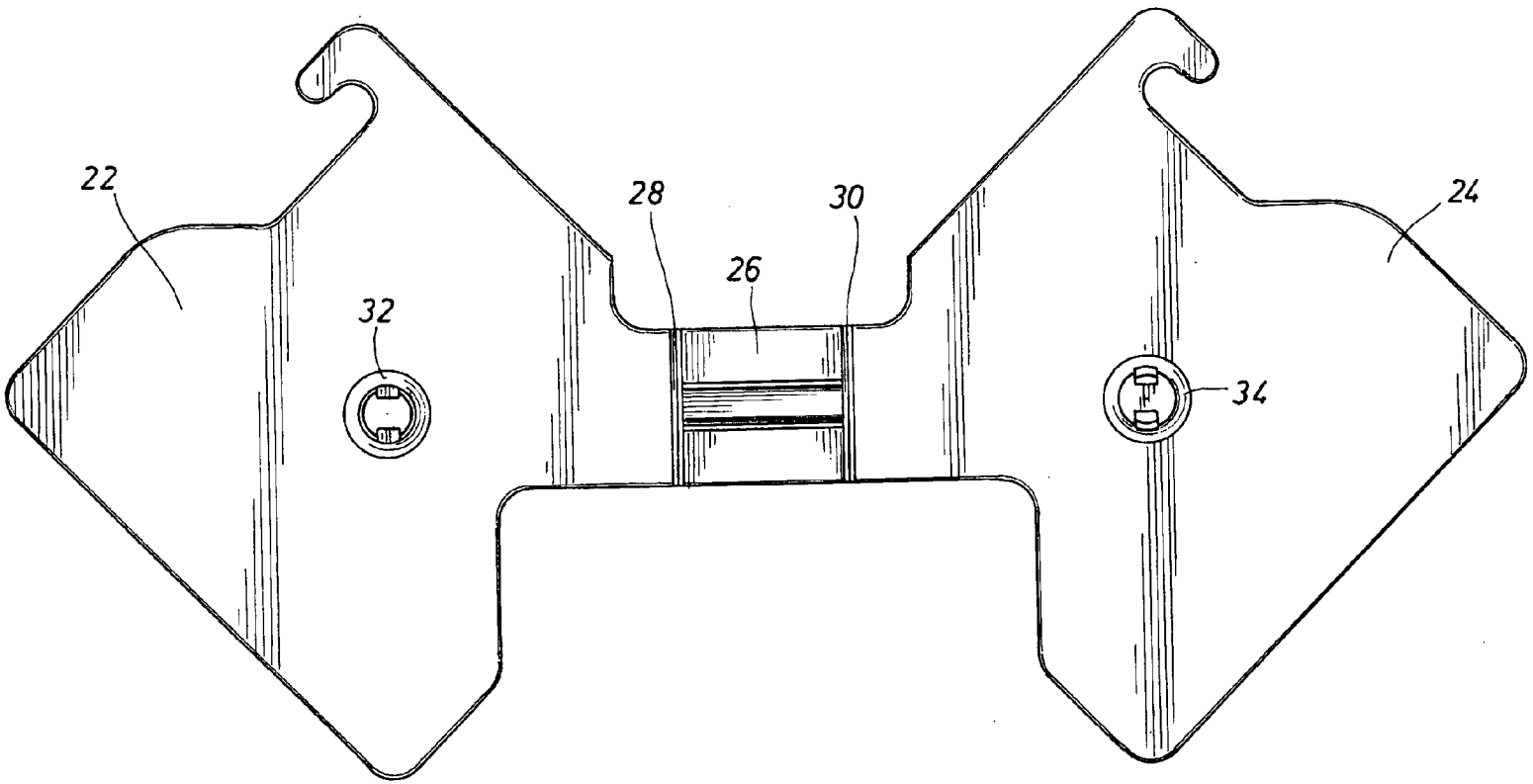
FIG. 8 is a pre-assembled plan view of the present invention.
Figure 9:
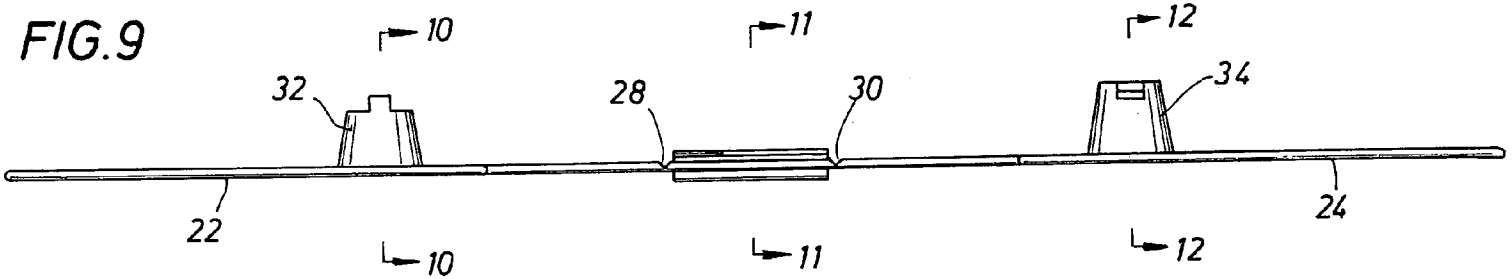
FIG. 9 is a pre-assembled elevation view of the present invention.

Referring now to FIGS. 8–14, the present invention is preferable manufactured as a single piece. This would be accomplished by a mold injection process well known to those skilled in the art. Preferably, the product is molded as a single piece of plastic such as polypropylene or polyethylene. The present invention would likely be manufactured as a generally flat member as shown in FIGS. 8–9. In such a configuration, the present invention would include the various elements as discussed above with respect to FIGS. 1–7. That is, the present invention includes two side panels 22–24 which are molded as an integral piece with a front panel 26.

The molded product would preferably include scored edges 28, 30 to enable the user, or the person assembling the present invention, to easily bend each side panel 22, 24 to approximately a ninety degree angle relative to front panel 26. Also shown in FIGS. 8–9 are protruding pins 32, 34 which are preferably molded as an integral piece of side panels 22, 24 respectively.

Figure 12:
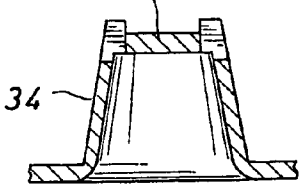
FIG. 12 is a cross-sectional view taken along line 12—12 of FIG. 9.
Figure 10:
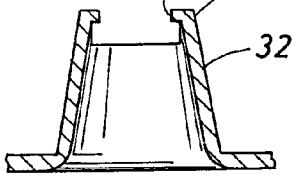
FIG. 10 is a cross-sectional view taken along line 10—10 of FIG. 9.
Figure 14:
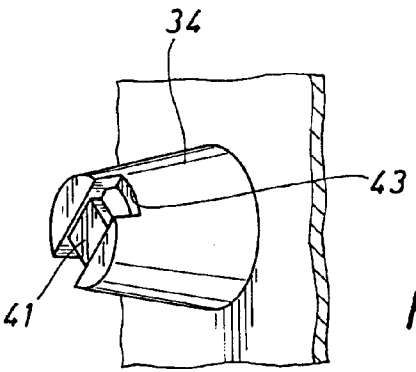
FIG. 14 is a perspective detailed view of the protruding pin shown in the cross-sectional view of FIG. 12.
Figure 13:
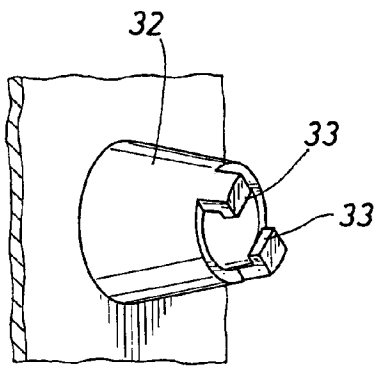
FIG. 13 is a perspective detailed view of the protruding pin shown in the cross-sectional view of FIG. 10.

Referring now to FIGS. 9–10 and 13, protruding pin 32 is generally conical in shape. It is preferably hollow to minimize the use of materials, although that is not necessary. As shown in FIGS. 10 and 13, protruding pin 32 includes clips 33. Each clip 33 has a lip 35 which extends generally inwardly as shown in FIGS. 10 and 13. Similarly, referring to FIGS. 9, 12, and 14, reciprocating pin 34 is also generally conical in shape. Once again, it may be hollow as shown in FIG. 12, although it could be solid but such is not necessary. Referring to FIGS. 12 and 14, the top of pin 34 is also open (as is pin 32), but pin 34 includes a transverse member 41 which spans the opening of the top of pin 34. The transverse member is recessed slightly below the top of pin 34 as shown in FIG. 12. Referring to FIG. 14, the length of transverse member 41 is selected so that the top of pin 34 can accommodate clips 33 and engage in a snug fit when assembled so that the top of clips 33 fit against ledge 43 of protruding pin 34. In this manner, protruding pins 32 and 33 are fixedly engaged, flush against one another, and cannot be easily separated as shown in FIGS. 2, 4, 6, and 7.

Figure 11:
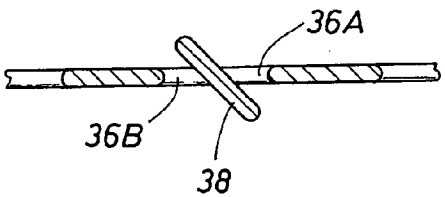
FIG. 11 is a cross-sectional view taken along line 11—11 of FIG. 9.

Referring to FIG. 11, dispensing bar 38 is illustrated in a cross-sectional view spanning aperture 36 thereby defining regions 36A and 36B. As noted above, regions 36A and 36B provide the openings for the user, or the person assembling the present invention, to thread roll 42 therethrough.

Referring to FIGS. 15 and 16, the present invention is shown in an assembled fashion supporting a roll 42, and suspended from a bar 60. Bar 62 serves to provide lateral stability preventing the present invention from rotating about bar 60. Roll 42 has been placed within the present invention and is centrally supported by protruding pins 32, 34. Thus, pins 32, 34 serve as an axle or center roller pin to support roll 42 within the present invention. By suspending the dispenser from a shelf or bar, additional counter surface is provided. Additionally, since the dispenser is preferable made of plastic it can be easily cleaned and therefore, improves sanitation.

In the assembly of the present invention, the operator or the assembler, takes the present invention as shown in FIG. 8 and bends side panels 22, 24 along scored edges 28 and 30 until each side panel 22, 24 is generally normal to front panel 26. Before reaching a final normal position of the side panels relative to the front panel, the user or assembler would insert a roll of labels or adhesive tape as shown in FIG. 15 on either protruding pin 32 of 34 and then press side panel 22 against side panel 24 snapping protruding pin 32 within 34 by means of clips 33 against transverse member 41. This defines an axle to support roll 42. The user or assembler would then thread roll 42 first through region 36A and then through region 36B. In this manner, as roll 42 is pulled in the direction of arrow 44 as shown in FIG. 15, label 40 is peeled off the roll. In the case of adhesive tape, the top edge 63 (see FIG. 1) of dispensing bar 38 may be serrated. As adhesive tape is only threaded through region 36A (and not region 36B), the user would serrate portions of adhesive tape from the roll along serrated edge 63 as the need arises. The assembly is particularly fast and thus permits a large number of dispensers to be assembled and filled in short order.

The present invention has been described in terms of a preferred embodiment. Obviously, modifications and alterations to this embodiment will be apparent to those skilled in the art in view of this disclosure. It is, therefore, intended that all such equivalent modifications and variations fall within the spirit and scope of the present invention as claimed.

What is claimed is:

1. A single piece roll dispenser for dispensing a roll of labels having a tape portion and a label portion comprising:

a single piece comprising:

a first panel;

a front panel having first and second substantially parallel edges and attached along said first edge to said first panel;

a second panel attached to said front panel along said second edge of said front panel, said first panel having a protruding pin generally proximate the center of said front panel, said second panel having a protruding pin generally proximate the center of said second panel, wherein the distal end of said protruding pin of said first panel and the distal end of said protruding pin of said second panel fixedly engage providing support for the roll, said first panel having a hook along one edge of said first panel generally distal the edge of said first panel attached to said front panel, and an open region below said hook of said first panel, said second panel having a hook along one edge of said second panel generally distal the edge of said second panel attached to said front panel, and an open region below said hook of said second panel, wherein each of said regions are adapted to engage a support offering lateral resistance to the dispenser prohibiting rotation of the dispenser about said hooks;

an aperture defined by said front panel; and an angled dispensing bar centrally supported within said aperture, said dispensing bar allowing the label to be separated from the tape at the edge of said dispensing bar.

2. The dispenser of claim 1, wherein the single piece dispenser is injection molded.

3. The dispenser of claim 1, wherein the first and second substantially parallel edges of said front panel are scored edges.

4. The dispenser of claim 1, wherein the protruding pin of said first panel, and the protruding pin of said second panel are generally conical in shape.

5. The dispenser of claim 1, wherein the dispensing bar divides said aperture into a first and second region and the tape portion of the roll of labels is threaded through said first and second regions, allowing the label to be separated from the tape at the edge of said dispensing bar.

* * * * *